US011771229B2

(12) United States Patent
Park

(10) Patent No.: US 11,771,229 B2
(45) Date of Patent: Oct. 3, 2023

(54) MOVABLE CHAIR PROVIDED WITH CABLE PROTECTING MEANS

(71) Applicant: TROUND INC., Hanam-si (KR)

(72) Inventor: Jea Bum Park, Namyangju-si (KR)

(73) Assignee: TROUND INC., Hanam-si (KR)

( * ) Notice: Subject to any disclaimer, the term of this patent is extended or adjusted under 35 U.S.C. 154(b) by 0 days.

(21) Appl. No.: 17/731,491

(22) Filed: Apr. 28, 2022

(65) Prior Publication Data

US 2022/0248859 A1 Aug. 11, 2022

Related U.S. Application Data

(63) Continuation of application No. PCT/KR2020/014634, filed on Oct. 26, 2020.

(30) Foreign Application Priority Data

Oct. 30, 2019 (KR) ..... 10-2019-0136008
Oct. 23, 2020 (KR) ..... 10-2020-0138346

(51) Int. Cl.
*A47C 7/72* (2006.01)
*E05B 73/00* (2006.01)
*H04R 5/02* (2006.01)

(52) U.S. Cl.
CPC ..... *A47C 7/727* (2018.08); *E05B 73/0005* (2013.01); *H04R 5/023* (2013.01)

(58) Field of Classification Search
CPC ..... A47C 7/727; A47C 7/723; E05B 67/003; E05B 67/006
USPC ..... 297/217.3, 217.4, 134, 174 R, 463.1, 297/463.2; 248/551–553
See application file for complete search history.

(56) References Cited

U.S. PATENT DOCUMENTS 3,781,861 A * 12/1973 Adler, Jr. ..... B62H 5/003 340/427
4,118,902 A * 10/1978 Saxton ..... E05B 73/0005 52/27
4,440,443 A * 4/1984 Nordskog ..... B60N 2/882 297/217.4
4,854,301 A * 8/1989 Nakajima ..... A61B 90/50 600/102
5,974,840 A * 11/1999 Kao ..... E05B 73/0005 70/58

(Continued)

FOREIGN PATENT DOCUMENTS

JP 2000-004983 A 1/2000
JP 2000-166657 A 6/2000

(Continued)

OTHER PUBLICATIONS 4 page PDF of translation of written opinion dated Jul. 20, 2021 for PCT/KR2020/014634. (Year: 2021).*

(Continued)

*Primary Examiner* — Robert Canfield
(74) *Attorney, Agent, or Firm* — Studebaker & Brackett PC

(57) ABSTRACT

The present invention relates to a movable chair provided with a cable protecting means, and more specifically, to a movable chair provided with a cable protecting means capable of preventing disconnection and breakage of various types of cables connected to the movable chair by restricting a moving or rotational radius of the movable chair.

15 Claims, 8 Drawing Sheets

(56) References Cited

U.S. PATENT DOCUMENTS

| | | | | |
|---|---|---|---|---|
| 6,003,940 | A * | 12/1999 | Jackson | A47C 7/543 297/217.3 |
| 6,557,943 | B2 * | 5/2003 | Ando | A47C 7/72 248/51 |
| 9,222,285 | B1 * | 12/2015 | Ilislamloo | G08B 3/10 |
| 2002/0104157 | A1 * | 8/2002 | Wheaton | E04H 12/2261 4/496 |
| 2011/0072862 | A1 * | 3/2011 | Avganim | E05B 73/0005 70/58 |
| 2012/0006078 | A1 * | 1/2012 | On | E05B 73/0005 70/20 |
| 2019/0328141 | A1 * | 10/2019 | Cheng | A47C 7/72 |
| 2021/0102410 | A1 * | 4/2021 | Smiley, III | E05B 73/0005 |
| 2021/0127841 | A1 * | 5/2021 | Park | A47C 7/727 |
| 2022/0395101 | A1 * | 12/2022 | Park | B60N 2/879 |
| 2023/0148758 | A1 * | 5/2023 | Park | A47C 7/38 297/217.4 |
| 2023/0165378 | A1 * | 6/2023 | Park | H04R 1/026 297/217.4 |
| 2023/0179918 | A1 * | 6/2023 | Park | A47C 7/62 381/301 |

FOREIGN PATENT DOCUMENTS

| | | | |
|---|---|---|---|
| JP | 2002-125786 | A | 5/2002 |
| JP | 3108348 | U | 4/2005 |
| JP | 3222993 | U | 9/2019 |
| KR | 20-0187324 | Y1 | 7/2001 |
| KR | 20-0243552 | Y1 | 10/2001 |
| KR | 10-2007-0101708 | A | 10/2007 |
| KR | 20-2009-0007765 | U | 7/2009 |
| KR | 10-2011-0029240 | A | 3/2011 |
| KR | 10-2012-0057040 | A | 6/2012 |
| KR | 10-2016-0044631 | A | 4/2016 |
| KR | 10-2153707 | * | 9/2020 |

OTHER PUBLICATIONS

International Search Report issued in PCT/KR2020/014634; dated Jul. 20, 2021.

* cited by examiner

MOVABLE CHAIR PROVIDED WITH CABLE PROTECTING MEANS

CROSS-REFERENCE TO RELATED APPLICATION

This application is based on the PCT Application No. PCT/KR2020/014634, filed on Oct. 26, 2020, and claims the benefit of priority from the prior Korean Patent Application No. 10-2019-0136008, filed on Oct. 30, 2019, and Korean Patent Application No. 10-2020-0138346, filed on Oct. 23, 2020, the disclosure of which is incorporated herein by reference in its entirety.

BACKGROUND

1. Field of the Invention

The present invention relates to a movable chair provided with a cable protecting means, and more specifically, to a movable chair provided with a cable protecting means capable of preventing disconnection and breakage of various types of cables connected to the movable chair by restricting a moving or rotational radius of the movable chair.

2. Discussion of Related Art

Generally, many chairs with different materials or structures from each other according to brand features of manufacturing companies are proposed to improve seating and moving convenience and/or the like of users.

With the development of this technology, massage chairs in which a massage apparatus and a chair are combined and multimedia chairs in which a speaker or a display apparatus is installed have been recently introduced in order to satisfy various desires of customers.

In the case of such a functional chair, a power cable, a speaker cable, and/or a display cable should be essentially installed to drive a massage apparatus, a speaker, or a display apparatus.

Generally, when a cable is installed in a movable apparatus, a problem of disconnection, or both disconnection and breakage, of the cable inevitably occurs. In the case of a massage chair (chair-type massage apparatus) disclosed in Korean Patent Publication No. 10-2016-0044631 (Published on Apr. 26, 2016), since the massage chair cannot move due to its large volume and heavy weight, a problem of disconnection or both disconnection and breakage of a cable does not need to be seriously considered.

Meanwhile, in Korean Patent Publication No. 10-2012-0057040 (Published on Jun. 5, 2012), a cable clamp device for a vibrating seat is disclosed.

The cable clamp device is a device for connecting and fixing cables of a vibrating seat which is installed in a theater or the like and allows sensation of sound and vibration, and connector bundles of cables at a back side, a seat side, and a switch side and a main cable side are installed in a space therein so that interference with the connector bundles, damage to the connector bundles, or the like can be prevented, and the cable bundles are protected from various types of contamination materials such as drinking water.

However, similar to the above-described massage chair, since movement of the vibrating seat is not presupposed, a disconnection problem of a cable due to irregular movement of a vibrating seat is not considered, and thus there is a limitation that the cable installed in the movable chair is not effectively protected.

SUMMARY OF THE INVENTION

The present invention is directed to providing a movable chair which is presupposed to move and is provided with a cable protecting means capable of preventing disconnection and breakage of various types of cables connected to the movable chair by restricting a moving or rotational radius of the movable chair.

In addition, the present invention is directed to providing a movable chair which is a specific example of the movable chair provided with a cable protecting means and in which a speaker mounting member is installed on a headrest part of the movable chair to implement a multi-channel sound system.

Objectives of the present invention are not limited to the above-described objectives, and other objectives and advantages of the present invention may be understood from the following descriptions and clearly understood from embodiments of the present invention. In addition, it may be seen that the objectives and the advantages of the present invention may be realized using elements described in the appended claims and combinations thereof.

One aspect of the present invention provides a movable chair provided with a cable protecting means, the movable chair at least including 1) a backrest part which supports a back and waist portion of a user, and 2) a seat part which supports a hip portion and a part of a leg of the user, wherein the backrest part or the seat part includes a main reception part which is installed in a predetermined region of the backrest part or the seat part, is connected to a main cable, and receives an arbitrary signal provided through the main cable, a main connection part provided at a position adjacent to the main reception part, and a main connection cable having one end connected to the main connection part and the other end connected to an arbitrary structure to restrict a moving radius of the movable chair.

In addition, another aspect of the present invention provides a movable chair provided with a cable protecting means, the movable chair at least including 1) a backrest part which supports a back and waist portion of a user, 2) a seat part which supports a hip portion and a part of a leg of the user, and 3) a side support which supports a side portion of the user, wherein the side support includes a main reception part which is installed in a predetermined region of the side support, is connected to a main cable, and receives an arbitrary signal provided through the main cable, a main connection part provided at a position adjacent to the main reception part, and a main connection cable having one end connected to the main connection part and the other end connected to an arbitrary structure to restrict a moving radius of the movable chair. In addition, still another aspect of the present invention may provide the movable chair further including a headrest part which supports a head of the user and in which a speaker mounting member is installed, the speaker mounting member may include at least one frame installed in the headrest part, the frame may be provided to extend in a forward direction of the chair, a speaker installation region in which at least one speaker is installed may be defined in an extending direction of the frame, and the main cable may include a power cable through which power is supplied to the speaker and a speaker cable through which an audio signal is provided to the speaker.

[Advantageous Effects]

As described above, according to the present invention, since a moving or rotational radius of a movable chair can be restricted by the cable protecting means, a user's worry about disconnection and damage of various types of cables connected to the mobile chair can be relieved.

In addition, according to the present invention, a movable chair which is a specific example of the movable chair provided with a cable protecting means and in which a speaker mounting member is installed on a headrest part of the movable chair to implement a multi-channel sound system can be provided so that a vivid sound experience as if a user were in a real video or game environment can be provided to the user by the user simply sitting in the chair.

Specific effects including the above-described effects of the present invention will be described while describing specific embodiments for implementing the present invention.

DETAILED DESCRIPTION OF EXEMPLARY EMBODIMENTS

Figure 1:
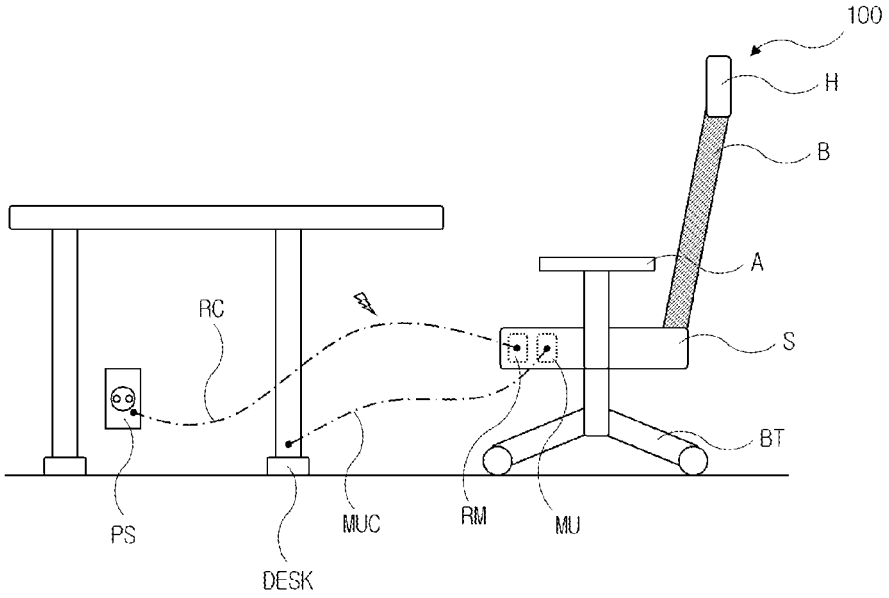
FIG. 1 is a side view illustrating a movable chair according to one embodiment of the present invention.

For the convenience of more easily understanding of the present invention, specific terms are defined in the present specification. Unless otherwise defined, scientific terms and technical terms used in the present invention have meanings which are generally understood by those skilled in the art. In addition, unless the context clearly indicates otherwise, singular forms include plural forms thereof, and plural forms include singular forms thereof.

Hereinafter, a movable chair provided with a cable protecting means according to some embodiments of the present invention will be described in more detail with reference to the drawings accompanying the present specification. In addition, content related to the chair according to some embodiments of the present invention which will be described with reference to the drawings accompanying the present specification will be understood as independent embodiments, and if necessary, at least two embodiments may also be combined. Meanwhile, components which are not sufficiently described with reference to the drawings accompanying the specification may be corresponding components according to embodiments previously described or to be described.

According to one aspect of the present invention, provided is a movable chair which at least includes 1) a backrest part which supports a back and waist portion of a user and 2) a seat part which supports a hip portion and a part of a leg of the user, wherein the movable chair includes a main reception part which is installed in a predetermined region of the chair, is connected to a main cable, and receives an arbitrary signal provided through the main cable, a main connection part provided at a position adjacent to the main reception part, and a main connection cable having one end connected to the main connection part and the other end connected to an arbitrary structure to restrict a moving radius of the movable chair. In this case, the chair may optionally include a headrest part which supports a head of the user, and in this case, the headrest part may be provided integrally with or separately from the backrest part. When the headrest part is provided separately from the backrest part, the headrest part may be separated from the backrest part. In addition, when the headrest part is integrally provided with the backrest part, the headrest part and the backrest part may be provided substantially as a single part in which the headrest part and the backrest part cannot be distinguished from each other.

Accordingly, even when the headrest part is illustrated on the chair illustrated in the drawings accompanying the present specification, the headrest part should be understood as a part which may be omitted or separated therefrom or a part which may be integrally formed with the backrest part.

In addition, the chair illustrated in the drawings accompanying the present specification is illustrated as a movable chair in which movable members (for example, wheels) are provided in a lower portion of the chair, but is not necessarily limited thereto, and the chair should be understood to also be provided as an immovable chair like a chair without wheels or a sofa type chair.

Figure 2:
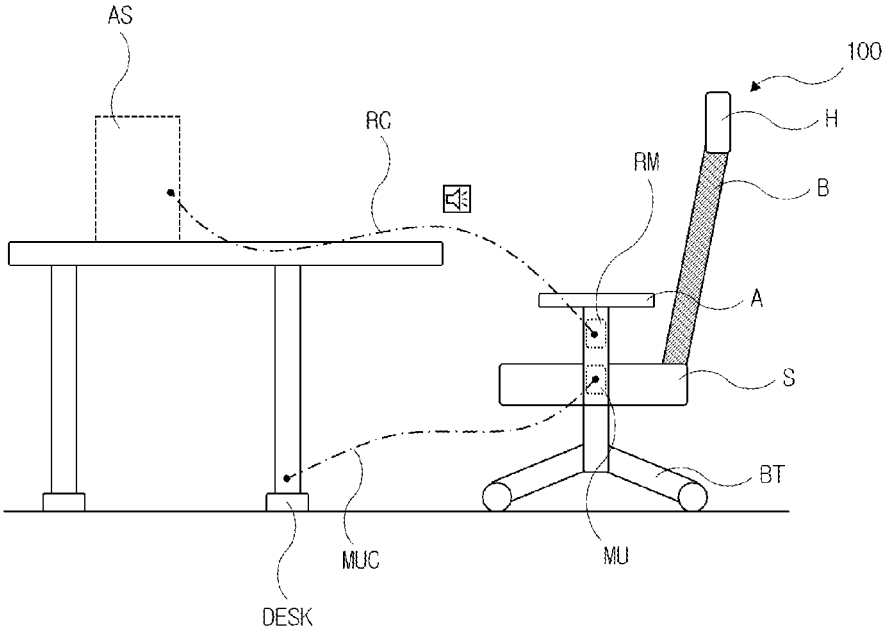
FIG. 2 is a side view illustrating a movable chair according to another embodiment of the present invention.

FIG. 1 is a side view illustrating a movable chair according to one embodiment of the present invention, and FIG. 2 is a side view illustrating a movable chair according to another embodiment of the present invention.

Referring to FIG. 1, a movable chair 100 may include a backrest part B which supports a back and waist portion of a user seated in the movable chair 100, a seat part S which supports a hip portion and a part of a leg of the user, and a headrest part H which supports a head of the user. As described above, the headrest part H may be installed on the backrest part B, and in this case, the headrest part H may be separated from the backrest part B or integrally formed with the backrest part B as necessary.

In the headrest part H, the backrest part B, and the seat part S, for the sake of convenience of the seated user, front portions or inner side portions (that is, portions disposed in such a direction that the back, waist, sides, and the like come in contact with the portions) may be formed of cushioned materials or formed in forms in which cushioned materials are attached thereto.

In addition, woofer speakers WS may be additionally provided in a front portion, an inner side, or in a rear surface of the backrest part B and/or the seat part S. Since vibration generated by the woofer speakers WS may be directly transferred to the user seated in the movable chair 100, there is an advantage of providing a more vivid experience to the user. A proper number of the woofer speakers WS may be installed inside the backrest part B and/or the seat part S in order to implement a multi-channel sound system.

In addition, for the sake of convenience of the user seated in the movable chair 100, at least one selected from among a speaker output means, a heating means, a ventilation means, and a massage means may be provided in the backrest part B and/or the seat part S.

A lower support BT may be provided under the seat part S, and the lower support BT may further include movable members such as wheels. In addition, the seat part S and the lower support BT may also be integrally provided as a member in which the seat part S and the lower support BT cannot be distinguished from each other.

In addition, the movable chair 100 may further include side supports A which support side surfaces of the user. The side supports A may include so-called armrest parts which support arm portions of the user seated in the movable chair 100 and may be individually provided to be installed at two sides of the seat part S as illustrated in FIGS. 1 and 2. Alternatively, the side supports A may be provided as members integrally formed with the seat part S and/or the backrest part B.

Referring to FIG. 1, a main reception part RM, which is connected to a main cable RC and receives an arbitrary signal provided through the main cable RC, is installed in a predetermined region of the seat part S, and referring to FIG. 2, a main reception part RM, which is connected to a main cable RC and receives an arbitrary signal provided through the main cable RC, is installed in a predetermined region of a side support A.

In this case, the region in which the main reception part RM is installed is not specifically limited but may be disposed at a suitable position at which the main cable RC is connected to an external structure away from the main reception part RM and the movable chair 100 to transmit or receive an arbitrary signal.

The main reception part RM is a part which is connected to an external structure disposed away from the movable chair 100 and receives the arbitrary signal, and when the main cable RC is a power cable connected to a power source PS for receiving power therefrom, the main reception part RM may be a power reception part. When the main cable RC is a display cable (for example, a Thundervolt cable, a high-definition multimedia interface (HDMI) cable, a digital visual interface (DVI) cable, a EDM cable), which is connected to a display source (for example, a computer, a set top box, and a game machine) for receiving a display signal, the main reception part RM may be a display reception part (in this case, at least one display apparatus may be provided within a visual range of the user seated in the movable chair 100). When the main cable RC is a speaker cable connected to an audio source AS (for example, a portable terminal, a computer, a television set (TV), a set top box, and a game machine) for receiving an audio signal, the main reception part RM may be an audio reception part (in this case, at least one speaker may be provided within a hearing range of the user seated in the movable chair 100).

For reference, in FIG. 1, it is illustrated that the main reception part RM is the power reception part, the main cable RC is the power cable, one end of the main cable RC is connected to the main reception part RM, and the other end is connected to the power source PS, and in FIG. 2, it is illustrated that the main reception part RM is the audio reception part, the main cable RC is the speaker cable, one end of the main cable RC is connected to the main reception part RM, and the other end is connected to the audio source AS.

Meanwhile, a main connection part MU connected to a main connection cable MUC is provided at a position adjacent to the main reception part RM installed in the predetermined region of the seat part S.

Specifically, one end of the main connection cable MUC is connected to the main connection part MU, and the other end is connected to an arbitrary structure to restrict a moving and/or rotational radius of the movable chair 100.

For reference, in FIG. 1, it is illustrated that one end of the main connection cable MUC is connected to the main connection part MU installed on the seat part S, and the other end is connected to a desk DESK, and in FIG. 2, it is illustrated that one end of a main connection cable MUC is connected to the main connection part MU installed in the side support A, and the other end is connected to a desk DESK.

In this case, the main connection cable MUC may have a proper length in order to restrict the moving and/or rotational radius of the movable chair 100, and more preferably, since the main connection cable MUC is provided to be elongated, an extension length of the main connection cable MUC may be adjusted in consideration of convenience of the user or an environment in which the movable chair 100 is installed. As will be described below, the extension length of the main connection cable MUC may be adjusted by a winding part to which a known means such as a reel is applied.

In addition, the extension length of the main connection cable MUC may be adjusted according to a length of the main cable RC. Particularly, more preferably, a maximum extension length of the main connection cable MUC may be smaller than or equal to a maximum extension length of the main cable RC. In this case, the extension length of the main connection cable MUC may be adjusted to be smaller than or equal to a separation limit length of the main cable RC. In this case, the separation limit length is a length at which the main cable RC may be separated from the main reception part RM due to movement of the chair 100.

In addition, the main connection cable MUC may be formed of an elastic material to reduce an impact applied to the main reception part RM and/or the main cable RC when the movable chair 100 moves beyond the maximum extension length of the main connection cable MUC. Even in this case, the maximum extension length of the main connection cable MUC may be smaller than or equal to the maximum extension length to the separation limit length of the main cable RC.

Figure 3:
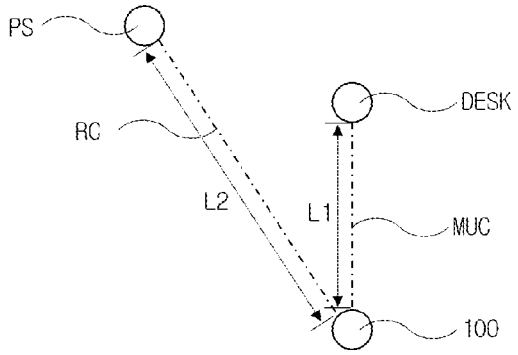
FIGS. 3 to 5 are views illustrating examples of changed extension lengths of a main cable and a main connection cable installed in a movable chair.
Figure 4:
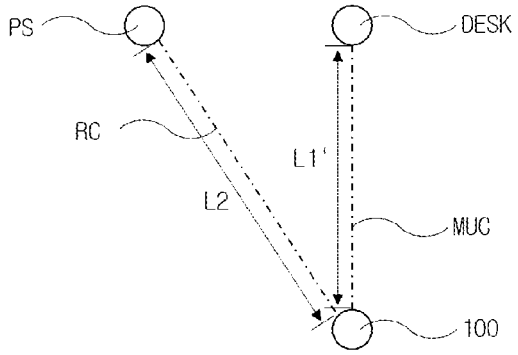
Figure 5:
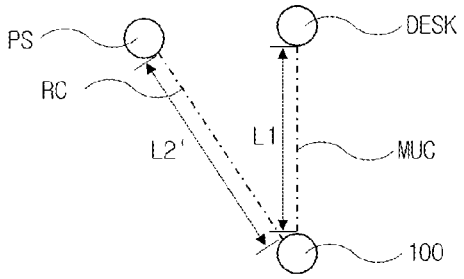

FIGS. 3 to 5 are views illustrating examples of changed extension lengths of the main cable and the main connection cable installed in the movable chair.

In FIGS. 3 to 5, it is illustrated that extension lengths of the main cable RC and the main connection cable MUC respectively connected to the main reception part RM and the main connection part MU of the movable chair 100 from the movable chair 100 are changed.

Referring to FIGS. 3 to 5, an extension length L2 of the main cable RC extending from the movable chair 100 and connected to the power source PS may be greater than an extension length L1 of the main connection cable MUC extending from the movable chair 100 and connected to the desk DESK.

In this case, due to a margin of the extension length L2 of the main cable RC, a state in which the main cable RC is not maximally elongated may be maintained.

In addition, as in FIG. 4, even when an extension length L1' of the main connection cable MUC increases when the movable chair 100 moves to a certain extent, due to the margin of the extension length L2 of the main cable RC, the state in which the main cable RC is not maximally elongated may be maintained.

Meanwhile, as illustrated in FIG. 5, even when an extension length L2' of the main cable RC decreases as a position of the movable chair 100 becomes close to a position of the power source PS, a minimum extension length L2' of the main cable RC may be adjusted to be greater than the extension length L1 of the main connection cable MUC.

Figure 6:
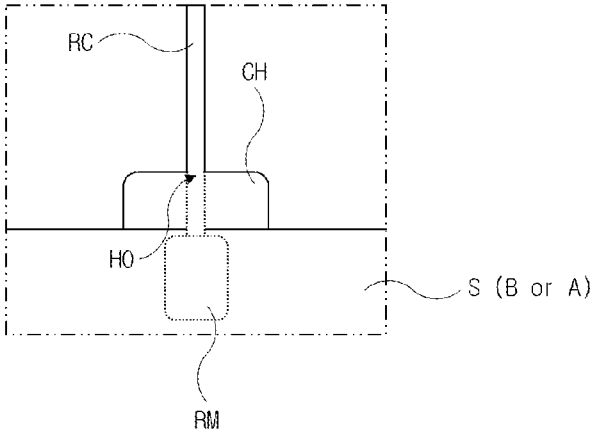
FIGS. 6 and 7 are views illustrating modified examples of a coupling housing installed in the movable chair.
Figure 7:
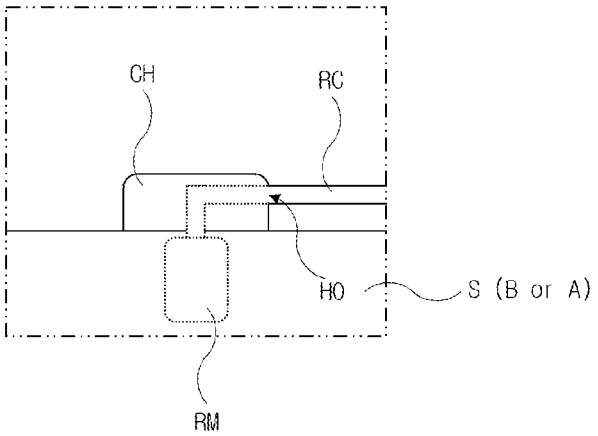

FIGS. 6 and 7 are views illustrating modified examples of a coupling housing installed in the movable chair.

Referring to FIGS. 6 and 7, a coupling housing CH surrounding an outer side of the main reception part RM may be additionally provided, and the main cable RC may move in or out through an opening part HO formed at one side of the coupling housing CH. As illustrated in FIGS. 6 and 7, the coupling housing CH may be formed to protrude from the backrest part B, the seat part S, or the side support A on which the main reception part RM is installed but is not necessarily limited thereto.

As illustrated in FIGS. 6 and 7, when the coupling housing CH surrounding the main reception part RM is provided at an outer side of the main reception part RM, and the main cable RC moves in or out through the opening part HO of the coupling housing CH, a connection portion of the main cable RC connected to the main reception part RM may be protected. Particularly, as illustrated in FIG. 7, since the main cable RC passes through the opening part HO from the main reception part RM to which one end of the main cable RC is connected in a state in which the main cable RC is bent one time, even when an external pulling force is applied to the main cable RC, the external force may be prevented from being transferred to the connection portion of the main cable RC and the main reception part RM without being changed.

In addition, although not separately illustrated, the coupling housing CH may be attached to and detached from the outer side of the main reception part RM. For example, in the state in which one end of the main cable RC is connected to the main reception part RM, and the main cable RC is connected to the main reception part RM, connection of the main reception part RM and the main cable RC may be firmly supported by coupling the coupling housing CH. Accordingly, the connection portion of the main cable RC connected to the main reception part RM may be protected, and the external force applied to the main cable RC may be reduced at the same time.

In addition, the main cable RC may be connected to the main reception part RM in a plug manner, and the coupling housing CH may protect the connection portion of the main cable RC and the main reception part RM.

FIGS. 8 to 12 are views illustrating modified examples of the coupling housing and the main connection part installed in the movable chair.

Figure 8:
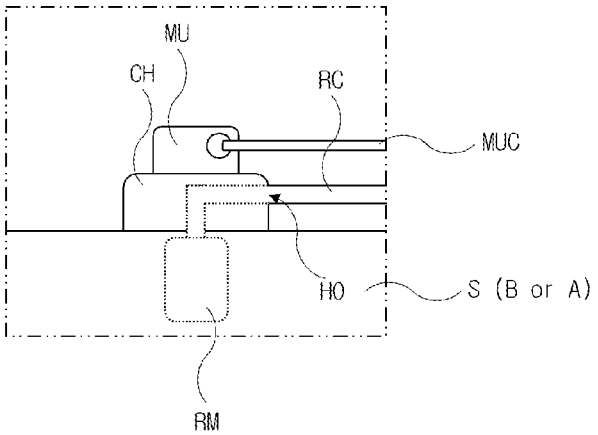
FIGS. 8 to 12 are views illustrating modified examples of a coupling housing and a main connection part installed in a movable chair.

Referring to FIG. 8, the main connection part MU may be installed at an outer side of the coupling housing CH. In this case, the main connection part MU may be integrally formed with the coupling housing CH.

In addition, although not separately illustrated, the main connection part MU may also be attached to and detached from the coupling housing CH as necessary. In addition, in a different case, since the coupling housing CH is detached from the outer side of the main reception part RM in a state in which the main connection part MU is attached to the coupling housing CH, the main connection part MU may be detached therefrom at the same time.

One end of the main connection cable MUC may be connected to the main connection part MU, and a connection method of the main connection cable MUC may be one of various known methods (a knot method, a hooking method, a Kensington lock method, and the like).

Figure 9:
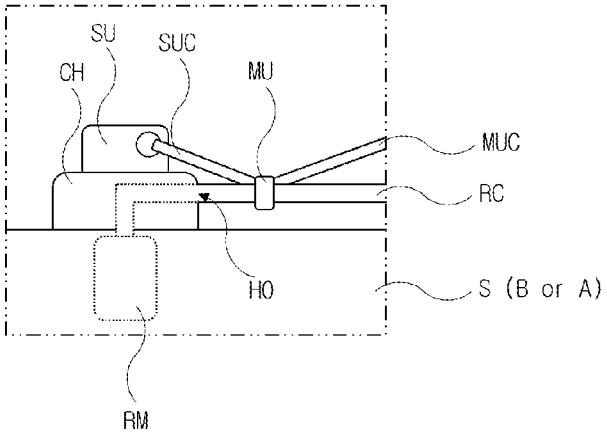
Figure 10:
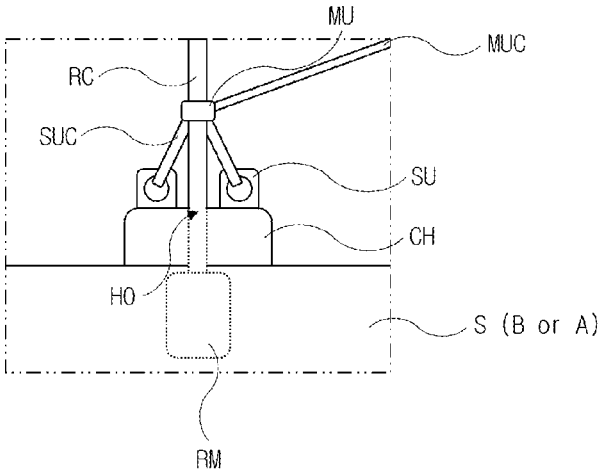

Referring to FIGS. 9 and 10 illustrating other modified examples, the main connection part MU may be installed at a position adjacent to the opening part HO of the coupling housing CH. In this case, the main connection part MU may be provided to surround the main cable RC passing through the opening part HO at the position adjacent to the opening part HO of the coupling housing CH. The main connection part MU may be firmly fixed to the position at which the main cable RC is surrounded, and as necessary, the position at which the main connection part MU surrounds the main cable RC may be adjusted.

Meanwhile, a sub-connection part SU is installed at the outer side of the coupling housing CH, and one end of a sub-connection cable SUC is connected to the sub-connection part SU. The other end of the sub-connection cable SUC is connected to the main connection part MU. The sub-connection part SU may be integrally formed with the coupling housing CH.

As described above, due to a connection structure among the sub-connection part SU installed at the outer side of the coupling housing CH, the sub-connection cable SUC having one end connected to the sub-connection part SU, and the main connection part MU, an over force may be prevented from being applied to the main cable RC connected to the main reception part RM.

In addition, since the main connection cable MUC having one end connected to the main connection part MU is still connected to an arbitrary structure, a moving radius of the movable chair 100 can be restricted.

Figure 11:
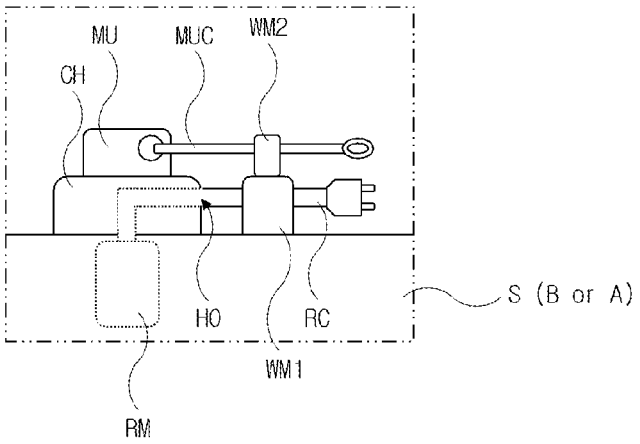

In addition, as illustrated in FIG. 11, a first winding part WM1 which is disposed at a position adjacent to the main reception part RM or integrally formed with the main reception part RM and around which the main cable RC is wound may be provided, and a second winding part WM2 which is disposed at a position adjacent to the main connection part MU and around which the main connection cable MUC is wound may be provided.

The first winding part WM1 and the second winding part WM2 may be provided as structures, such as reels, capable of adjusting the maximum extension lengths of the main cable RC and the main connection cable MUC in order to prevent the main cable RC and the main connection cable MUC from being elongated more than necessary or to reflect an intention of the user.

Figure 12:
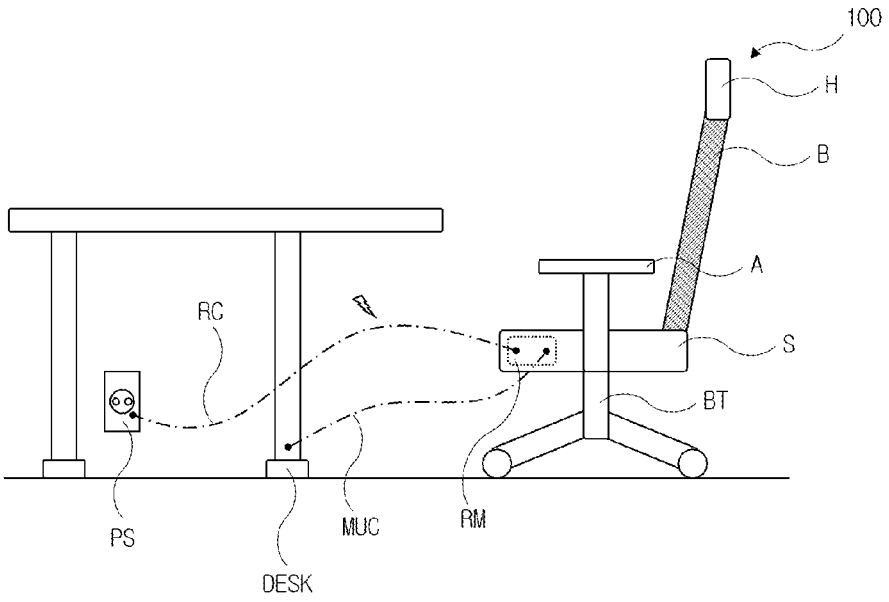

According to another modified example illustrated in FIG. 12, the main reception part RM and the main connection part MU may be an integrally formed structure, and in this case, the main cable RC and the main connection cable MUC may be individually connected to the structure.

In addition, the main reception part RM and the main cable RC may be integrally formed, the main connection part MU and the main connection cable MUC may be integrally formed, or the main reception part RM, the main connection part MU, and the main connection cable MUC may be integrally formed.

Figure 13:
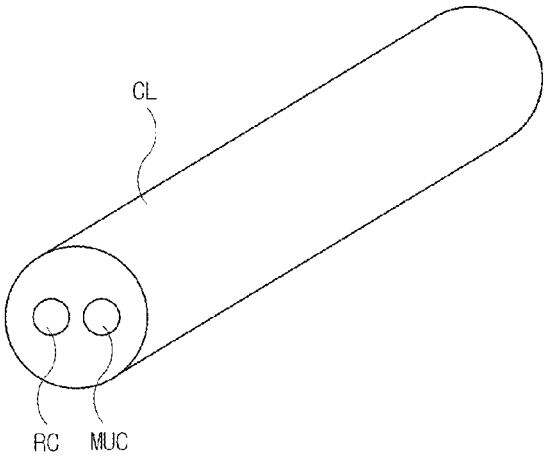
FIGS. 13 and 14 are views illustrating modified examples of a main cable and a main connection cable installed in a movable chair.
Figure 14:
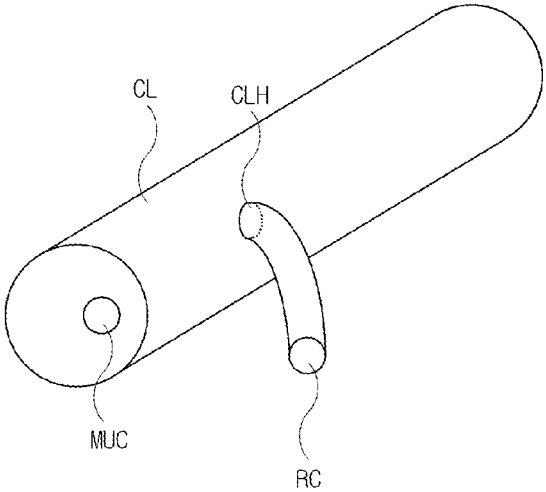

FIGS. 13 and 14 are views illustrating modified examples of the main cable and the main connection cable installed in the movable chair.

As the main reception part RM and the main connection part MU may be integrally formed, a connection structure between the movable chair 100 and an arbitrary structure may be further simplified, and in this case, as a cable illustrated in FIGS. 13 and 14 is used, there is a structural advantage, and safety (cable protection) can be further improved.

Specifically, referring to FIG. 13, the main cable RC and the main connection cable MUC may be provided as composite cable types surrounded by a single clad CL. The clad CL may be an irreversible clad from which the main cable RC and the main connection cable MUC are not separated, but may also be a separable clad capable of surrounding the main cable RC and the main connection cable MUC to a predetermined length. When the clad CL is separably provided, even when a type of the main cable RC is changed, there is an advantage in that the clad CL can be separated and the main cable RC can be replaced without purchasing a composite cable.

In addition, as illustrated in FIG. 14, the clad CL includes at least one opening part CLH in an arbitrary region, and in a state in which the main cable RC and/or the main connection cable MUC is surrounded by the clad CL, the main cable RC and/or the main connection cable MUC may enter from or exit to the outside of the clad CL at a position at which the opening part CLH is provided.

Figure 15:
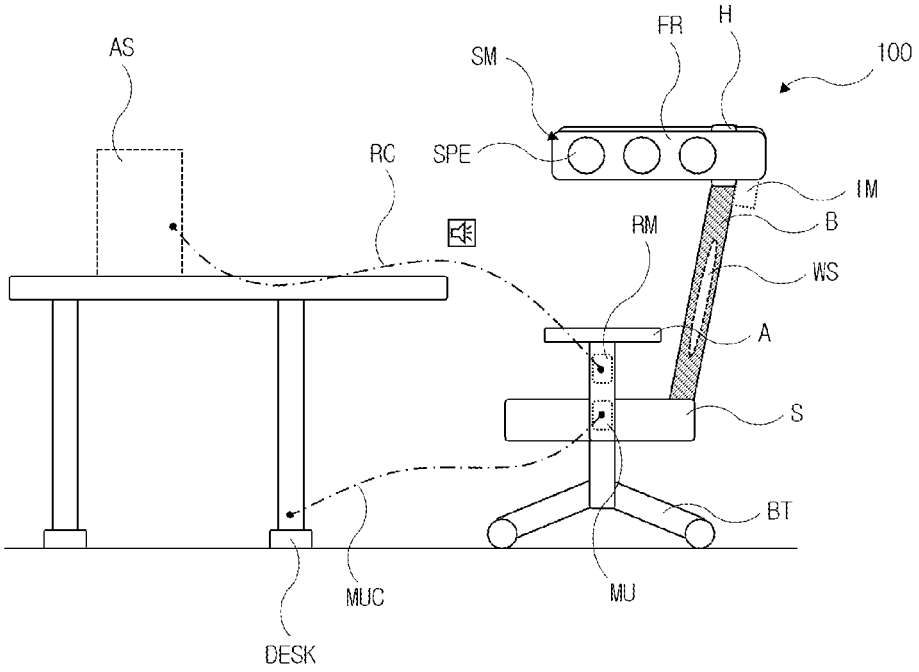
FIGS. 15 and 16 are side views illustrating a movable chair according to still another embodiment of the present invention.
Figure 16:
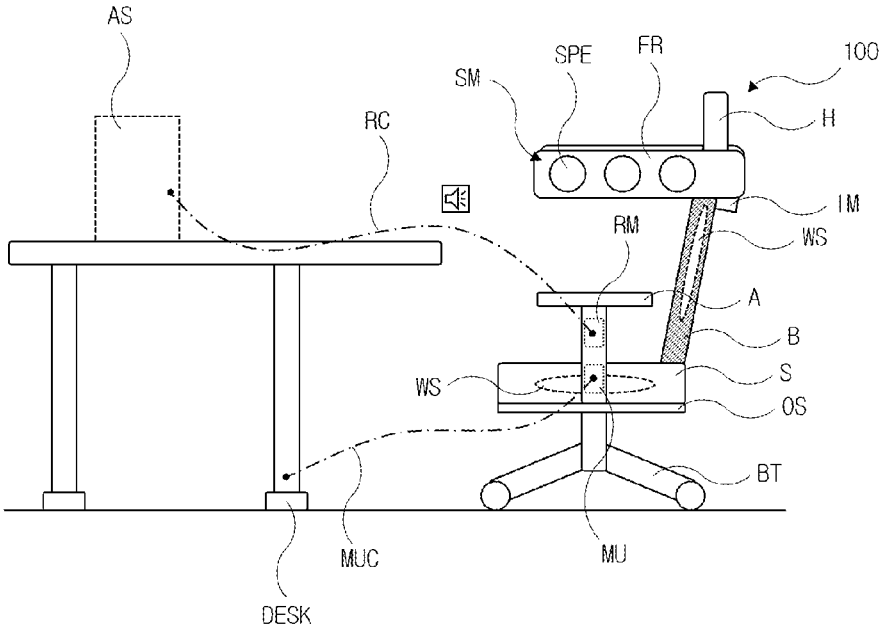
Figure 17:
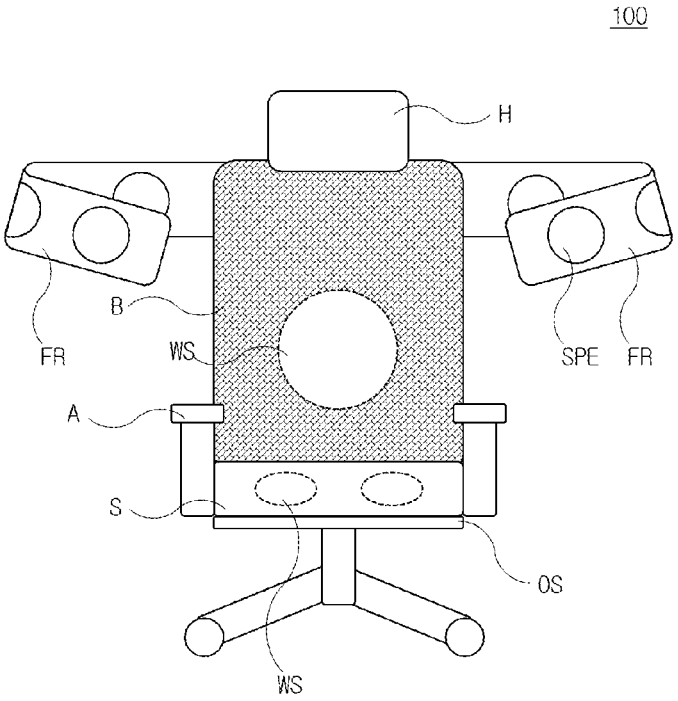
FIG. 17 is a front view illustrating the movable chair illustrated in FIGS. 15 and 16.

FIGS. 15 and 16 are side views illustrating the movable chair according to still another embodiment of the present invention, and FIG. 17 is a front view illustrating the movable chair illustrated in FIGS. 15 and 16.

Referring to FIGS. 15 to 17, as a speaker mounting member SM on which one or more speakers SPE are installed may be provided on the headrest part H, the multi-channel sound system may be implemented in the movable chair.

More specifically, the speaker mounting member SM includes at least one frame FR disposed in an inner side or on a rear surface of the headrest part H and extending from the headrest part H of the movable chair 100 in a forward direction of the movable chair 100 to have a predetermined length. A speaker installation region may be defined in the frame FR in an extending direction, and at least one speaker SPE may be installed in the speaker installation region.

Although not separately illustrated, a weight balancing member may be installed in the movable chair 100 in order to prevent the movable chair 100 from losing balance and falling due to a weight of the speaker SPE installed on the frame FR. The weight balancing member may be installed in a frame portion additionally extending from the frame in a direction opposite to a direction of the speaker with respect to a frame rotary shaft which will be described below. Meanwhile, in order to maintain a center of gravity of the movable chair 100 even when the weight of the speaker SPE is added, the weight balancing member may be installed on the lower support BT which supports the seat part S or a lower portion of the seat part S, or a weight of the lower support BT which supports the seat part S or the lower portion of the seat part S may also be increased.

In addition, the frame FR may also be formed of a light rigid material such as carbon fiber.

In addition, referring to FIG. 16, a vibration reduction member OS may be optionally provided between the seat part S and the lower support BT. The vibration reduction member OS serves to prevent vibration generated by the plurality of speakers disposed relatively higher than the seat part S from being transferred to a lower portion of the movable chair 100 or reduce the vibration.

When the frame FR is installed in the inner side of the headrest part H, the frame FR may have a shape protruding in at least one direction of two side directions of the headrest part H and extending in the forward direction of the movable chair 100 to have a predetermined length.

As illustrated in FIGS. 15 and 16, when the frame FR is installed on the rear surface of the headrest part H, a separate support member IM fixing the frame FR and the headrest part H may be interposed therebetween, and the frame FR may be installed on the support member IM and have a shape extending from the rear surface of the headrest part H in the forward direction of the movable chair 100 to have a predetermined length.

The speaker SPE may be integrally provided with the frame FR, or may be provided to be attachable to and detachable from the frame FR. In addition, a plurality of speakers SPE may also be connected to each other to form the frame FR.

A proper number of the frames FR installed on the headrest part H may be installed to implement the multi-channel sound system.

In this case, the speaker SPE may be a finished speaker, a speaker unit connected to a driving unit separately provided in a speaker installation region SA and operating as a finished product, a display type speaker, or a thin film type speaker, may include a one-way or multi-way speaker, and may receive an audio signal in a wired or wireless manner to operate.

In this case, the power reception part and the audio reception part may be integrally provided, and the power cable and the speaker cable may be provided as cables independent of each other or a composite cable which is formed to be surrounded by a clad by a predetermined length and is separable at two ends.

In addition, when the speaker SPE is the display speaker, the main cable RC may include at least a power cable, a speaker cable, and a display cable, and the main reception part RM may include a power reception part which is connected to the power source PS through the power cable and receives power for operating the speaker SPE, an audio reception part which is connected to the audio source AS included in a home theater, a TV, a set top box, a soundbar, a computer, a mobile phone, or a tablet, through the speaker cable and receives an audio signal output through the speaker SPE, and a display reception part which is connected to a video source included in a home theater, a TV, a set top box, a computer, a mobile phone, or a tablet, through the display cable and receives a display signal to be output.

In addition, a data processing/communication device including a computer may be installed in the chair 100. In this case, the main cable RC may include at least a power cable and a data communication cable.

In addition, the speaker SPE may be directly installed in the speaker installation region but is not necessarily limited thereto, and a separate speaker installation base may be interposed between the speaker installation region and the speaker SPE.

Meanwhile, the frame FR may have a straight line shape extending from the headrest part H in the forward direction of the movable chair 100 (or in a forward direction of the user seated in the movable chair 100) to have a predetermined length, and as necessary, may have any shape such as a non-straight line shape, a bent line shape, or a curved line shape.

In this case, the speaker SPE may be installed on an inner side surface of the frame FR, that is, a surface facing the user seated in the movable chair 100. In addition, the frame FR may have a shape bent from the backrest part B in the forward direction of the movable chair 100.

In addition, although not separately illustrated, a channel processing unit such as a receiver which serves functions of receiving, amplifying, and transferring a multi-channel audio signal may be provided in an arbitrary region of the movable chair 100, the audio source may be connected to the channel processing unit, and the multi-channel audio signal may be output to correspond to a channel provided in the movable chair 100.

Figure 18:
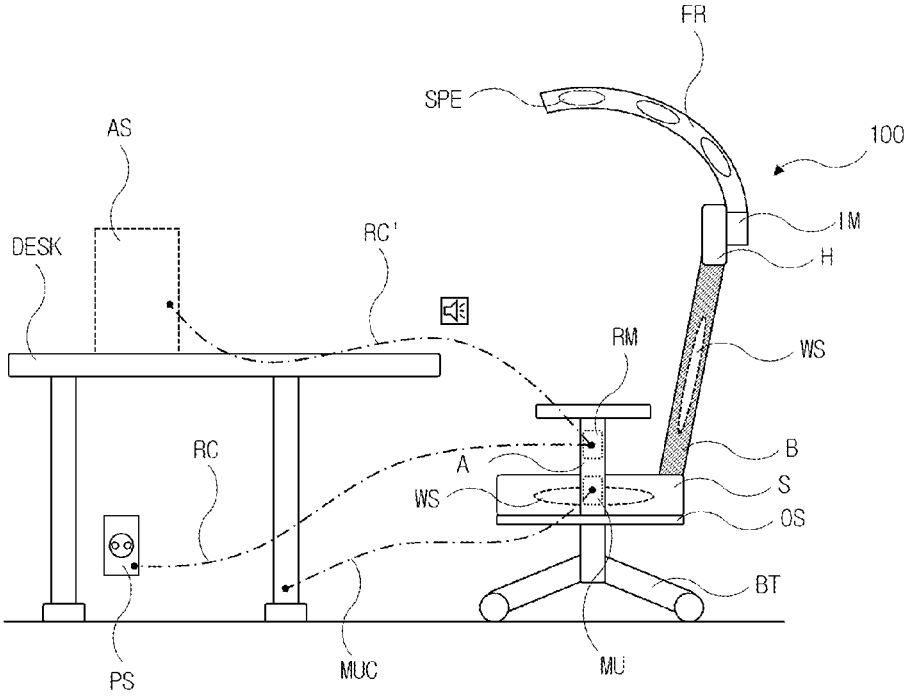
FIG. 18 is a side view illustrating a movable chair according to yet another embodiment of the present invention.

Referring to FIG. 18 illustrating a modified example of the chair illustrated in FIGS. 15 and 16, at least one frame FR, which extends over the user seated in the movable chair 100 in the forward direction to have a predetermined length instead of extending in a lateral direction of the user seated in the movable chair 100 illustrated in FIGS. 15 and 16, is installed in the headrest part H, and a speaker installation region in which at least one speaker SPE is installed may be defined in an extending direction of the frame FR.

Specific descriptions about the frame FR and the speaker SPE installed on the frame FR may be the same as those of the frame applied to the chair illustrated in FIGS. 15 to 17 but are not structurally limited to the above descriptions.

While exemplary embodiments of the present invention have been described above, the present invention may be variously modified and changed by those skilled in the art by adding, changing, and removing components without departing from the spirit of the present invention, and the other embodiments will fall within the scope of the present invention.

What is claimed is:

1. A movable chair provided with a cable protecting means, the movable chair at least comprising:

1) a backrest part which supports a back and waist portion of a user;

2) a seat part which supports a hip portion and a part of a leg of the user, wherein the backrest part or the seat part includes a main reception part which is installed in a predetermined region of the backrest part or the seat part, is connected to a main cable, and receives an arbitrary signal provided through the main cable, a main connection part provided at a position adjacent to the main reception part, and a main connection cable having one end connected to the main connection part and the other end connected to an arbitrary structure to restrict a moving radius of the movable chair; and a headrest part which supports a head of the user and in which a speaker mounting member is installed, wherein the speaker mounting member includes at least one frame installed in the headrest part;

the frame is provided to extend in a forward direction of the chair;

a speaker installation region in which at least one speaker is installed is defined in an extending direction of the frame; and the main cable includes a power cable through which power is supplied to the speaker and a speaker cable through which an audio signal is provided to the speaker.

2. The movable chair of claim 1, further comprising a coupling housing surrounding an outer side of the main reception part, wherein the main cable moves in or out through an opening part formed at one side of the coupling housing.

3. The movable chair of claim 2, wherein the main connection part is provided at an outer side of the coupling housing.

4. The movable chair of claim 2, wherein:

at least one sub-connection part is provided at an outer side of the coupling housing; and the other end of a sub-connection cable having one end connected to the sub-connection part is connected to the main cable by the main connection part at a position adjacent to the opening part of the coupling housing.

5. The movable chair of claim 1, wherein the main cable includes at least one selected from among a power cable, a display cable, a speaker cable, and a data communication cable.

6. The movable chair of claim 1, wherein the main cable and the main connection cable are surrounded by a single clad.

7. The movable chair of claim 6, wherein the clad includes at least one opening part through which the main cable moves in and out.

8. The movable chair of claim 1, comprising a first winding part around which the main cable is wound and which is provided at a position adjacent to the main reception part.

9. The movable chair of claim 1, comprising a second winding part around which the main connection cable is wound and which is provided at a position adjacent to the main connection part.

10. The movable chair of claim 1, wherein the main connection part and the main connection cable are integrally formed.

11. The movable chair of claim 1, wherein the main reception part, the main connection part, and the main connection cable are integrally formed.

12. The movable chair of claim 1, wherein:

a frame support member is positioned on a rear surface of the headrest part; and the frame is installed on the frame support member.

13. The movable chair of claim 1, wherein the frame extends from the headrest part in an upward direction of the user seated in the chair.

14. The movable chair of claim 1, wherein the frame extends from the headrest part in a lateral direction of the user seated in the chair.

15. A movable chair provided with a cable protecting means, the movable chair at least comprising:

1) A backrest part which supports a back and waist portion of a user;

2) a seat part which supports a hip portion and a part of a leg of the user;

3) a side support which supports a side portion of the user, wherein the side support includes a main reception part which is installed in a predetermined region of the side support, is connected to a main cable, and receives an arbitrary signal provided through the main cable, a main connection part provided at a position adjacent to the main reception part, and a main connection cable having one end connected to the main connection part and the other end connected to an arbitrary structure to restrict a moving radius of the movable chair; and a headrest part which supports a head of the user and in which a speaker mounting member is installed, wherein the speaker mounting member includes at least one frame installed in the headrest part;

the frame is provided to extend in a forward direction of the chair;

a speaker installation region in which at least one speaker is installed is defined in an extending direction of the frame; and the main cable includes a power cable through which power is supplied to the speaker and a speaker cable through which an audio signal is provided to the speaker.

* * * * *